US005697714A

United States Patent [19]

Onuki et al.

[11] Patent Number: 5,697,714

[45] Date of Patent: Dec. 16, 1997

[54] LINE PRINTER EQUIPPED WITH EASILY ASSEMBLED/REPLACEABLE PRINT HEAD

[75] Inventors: Hideki Onuki; Katsuari Sato; Satoru Konuma, all of Chiba, Japan

[73] Assignee: Seiko Instruments Inc., Japan

[21] Appl. No.: 364,119

[22] Filed: Dec. 27, 1994

[30] Foreign Application Priority Data

| | | | |
|---|---|---|---|
| Dec. 27, 1993 | [JP] | Japan | 5-333587 |
| Oct. 18, 1994 | [JP] | Japan | 6-252471 |

[51] Int. Cl.[6] ..... B41J 2/32

[52] U.S. Cl. ..... 400/120.16; 347/197

[58] Field of Search ..... 400/55, 56, 57, 400/58, 59, 120.16, 120.17, 653; 347/197, 198

[56] References Cited

U.S. PATENT DOCUMENTS

| | | | |
|---|---|---|---|
| 4,848,945 | 7/1989 | Sone | 400/120.17 |
| 5,023,628 | 6/1991 | Koch | 400/120.16 |
| 5,181,787 | 1/1993 | Hosomi | 400/55 |
| 5,366,302 | 11/1994 | Masumura et al. | 400/120.16 |

FOREIGN PATENT DOCUMENTS

| | | | |
|---|---|---|---|
| 392213 | 10/1990 | European Pat. Off. . | |
| 463595 | 1/1992 | European Pat. Off. . | |
| 62-193839 | 8/1987 | Japan | 400/58 |
| 2-108577 | 4/1990 | Japan | 347/197 |
| 4-140176 | 5/1992 | Japan | 347/197 |

OTHER PUBLICATIONS

Patent Abstract of Japan, vol. 10, No. 130 (M–478); 60–255469 17 Dec. 1985.

Patent Abstract of Japan, vol. 15, No. 432 (M–1175); 3–182377 8 Aug. 1991.

*Primary Examiner*—David A. Wiecking

*Attorney, Agent, or Firm*—Adams & Wilks

[57] ABSTRACT

A line printer comprises a frame having a pair of spaced-apart side walls, a platen having a shaft mounted to the side walls for pivotal movement, a print head interposed between the side walls and positioned in pressure contact with the platen, and a head-up lever mounted on one of the side walls for releasing the print head from pressure contact with the platen. The head-up lever is mounted on the shaft of the platen for pivotal movement relative thereto.

6 Claims, 5 Drawing Sheets

LINE PRINTER EQUIPPED WITH EASILY ASSEMBLED/REPLACEABLE PRINT HEAD

BACKGROUND OF THE INVENTION

The present invention generally relates to a print head structure of a line printer. More specifically, the present invention is directed to an easily assembled/replaceable print head employed in a line printer. Conventionally, a compact line printer is assembled with an employment of a frame having a pair of side walls which are separately arranged opposite to each other along the cross direction, and a platen is pivotally journalled on the both side walls. The print head such as a thermal head and the like used to print out the externally entered recording data on the recording paper is provided in pressure contact with the platen inbetween the both side walls. Further, a head-up lever is mounted on one of the side walls to release the pressure contact with the platen by acting on the print head. The print is made on the recording paper which has been supplied between the platen and the print head under pressure contact condition. Then, the recording paper is replaced upon release of the pressure contact.

The head-up lever is pivotally operated so as to release the pressure contact of the print head against the platen, but the conventional head-up lever is journalled to the pin planted on one of side walls of the frame. However, the pin must be planted on the side wall of the frame in order to mount the head-up lever. As a result, there is a drawback that the total number of parts or components of the conventional line printer and also assembling steps thereof are increased.

Further, the print head is so constructed that this head is mounted on the shaft extended between a pair of side walls of the frame. As a consequence, there are other drawbacks that assembly of the conventional line printer becomes complex and the replacement of the print head can not be easily performed during a repair operation.

Moreover, it is technically difficult to maintain the parallel relationship between the platen and the print head with high precision. Therefore, there is another problem that coasting and the like of the recording paper may occur during the printing operation.

SUMMARY OF THE INVENTION

The present invention has been made in an attempt to solve the above-described drawbacks of the conventional line printer, and has an object to reduce the total number of components, or parts provided around the print head of a line printer. Another object of the present invention is to easily mount/dismount the print head on/from the frame, and also to readily replace this print head. Furthermore, an object of the present invention is to increase the positioning precision of the print head with respect to the platen, and also to avoid eccentric abutting.

To achieve these objects of the present invention, the following means are employed.

That is, according to a first aspect of a line printer of the present invention, there are provided a frame, a platen, a print head, and a head-up lever, in which the frame includes a pair of side walls separately located opposite to each other along the cross direction thereof, and the platen includes a rotation shaft journalled to both of the side walls. The print head is interposed between the side walls and is located in pressure contact with the platen. On the other hand, the head-up lever is mounted on one of side walls to cause the print head to release the pressure contact thereof against the platen.

In the above-described structure, the head-up lever is characterized in that this head-up lever is rotatably engaged with the rotation shaft of the platen. Concretely speaking, the head-up lever has a cylindrical projection fitted to the side wall of the frame, which functions as a bearing for the rotation shaft of the platen.

In accordance with a second aspect of the present invention, a line printer basically comprises a frame, a platen, and a print head.

The frame has a pair of side walls separately provided opposite to each other along the width direction, and the platen is rotatably journalled between both of the side walls. The print head is assembled between both of the side walls, and is provided in pressure contact with the platen.

With the above-described structure, a first guide groove and a second guide groove are formed on the respective side walls of the frame, near and far from the platen.

On the other hand, a first pin detachably engaged with the first guide groove, and a second pin detachable engaged with the second groove are integrally formed on the respective edge portions of the print head. Preferably, the positioning of the print head is performed with regard to the platen by engaging the first pin with the first guide groove. Also preferably, the second pin of the print head is journalled by the second guide groove under a floating condition, and functions as a free fulcrum when the pressure contact of the print head against the platen is released. Further, the print head is positioned in pressure contact with the platen in a parallel manner by way of the energizing force applied to the center point thereof along the width direction.

In accordance with a third aspect of the present invention, a line printer is comprises a frame, a platen, a print head, and a rear plate.

The frame has a pair of side walls separately positioned opposite to each other along the width direction thereof, and a platen is rotatably journalled between both of the side walls. The print head is detachably mounted between both side walls, and is in pressure contact with the platen in a parallel manner. The rear plate is detachably engaged with both of the side walls to hold the print head. Preferably, the print head is equipped with an elastic member abutting to the rear plate, and a lock lever made in an integral form while a supporting center shaft of this elastic member is used as a rotation center. The print head is parallel-positioned in pressure contact with the platen by receiving the energizing force of the elastic member. The lock lever is rotatably provided in the space between the rear plate and a ridge of the frame, so that the rear plate can be prevented from being easily removed.

As a result, the total number of parts of the line printer can be reduced and the total number of assembling steps can also be reduced. Positioning of a print head with respect to the platen is achieved by establishing a precise engagement between a first pin integrally formed on the edge portion of the print head and a first guide groove formed on a side wall of a frame. As a consequence, the correct positioning of the print head can be performed with respect to the platen.

On the other hand, a second pin of the print head is journalled under a floating condition by a second guide groove of the side wall of the frame. This second pin functions as a free fulcrum when the pressure contact of the print head is released.

As described above, a play is formed at the free fulcrum of the head-up lever, so that distortion of parts and machining tolerance can be absorbed. Since the energizing force given to the print head is performed by employing only one elastic member around a center of the platen in the upper direction, a so-called floating effect may be produced and eccentric abutting can be avoided. The print head is detachably assembled to the frame. The assembled print head is held by a rear plate which is similarly, detachably engaged with the frame. The elastic member is integrally assembled into the print head together with the lock lever.

As a result of the above-described structure, the print head can be simply assembled and can be easily replaced. Since the lock lever is provided in order that the rear plate is not easily removed, it is possible that the print head is prevented from being dismounted.

BRIEF DESCRIPTION OF THE DRAWINGS

For a better understanding of the present invention, reference is made of the detailed description to be read in conjunction with the accompanying drawings, in which.

DETAILED DESCRIPTION OF THE PREFERRED EMBODIMENTS

Figure 1A:
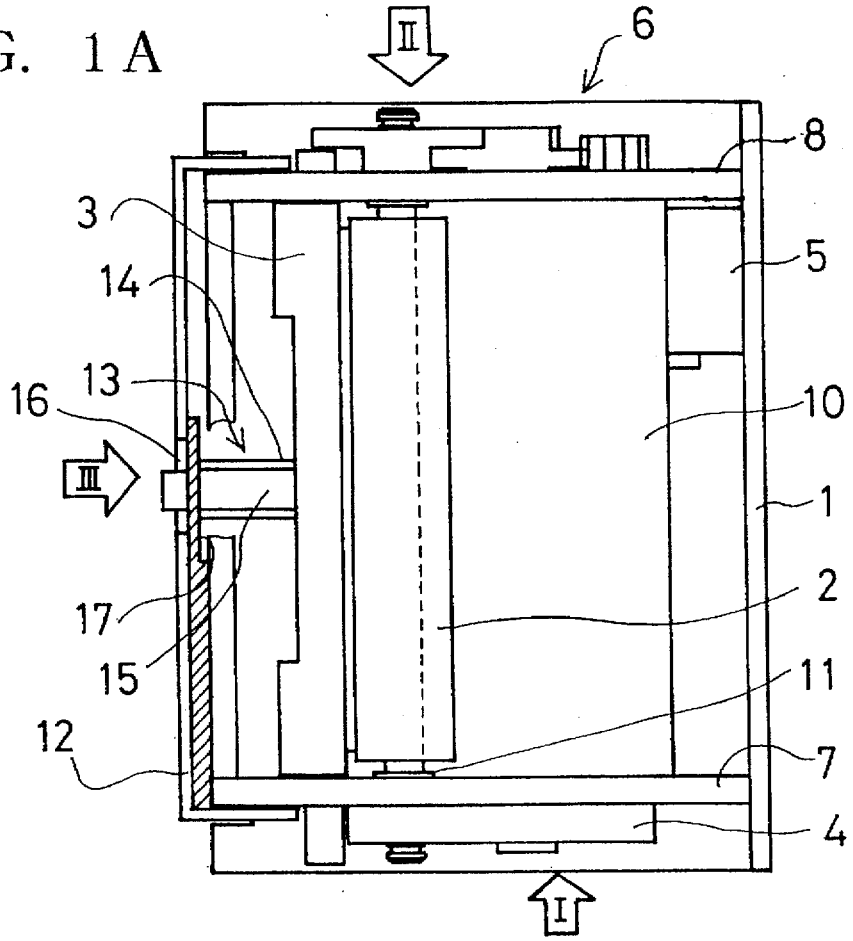
FIGS. 1A and 1B are a plan view and a side view for representing a line printer according to an embodiment of the present invention.

Referring now to the drawings, a print head of a line printer according to a preferred embodiment of the present invention will be described in detail.

Figure 1B:
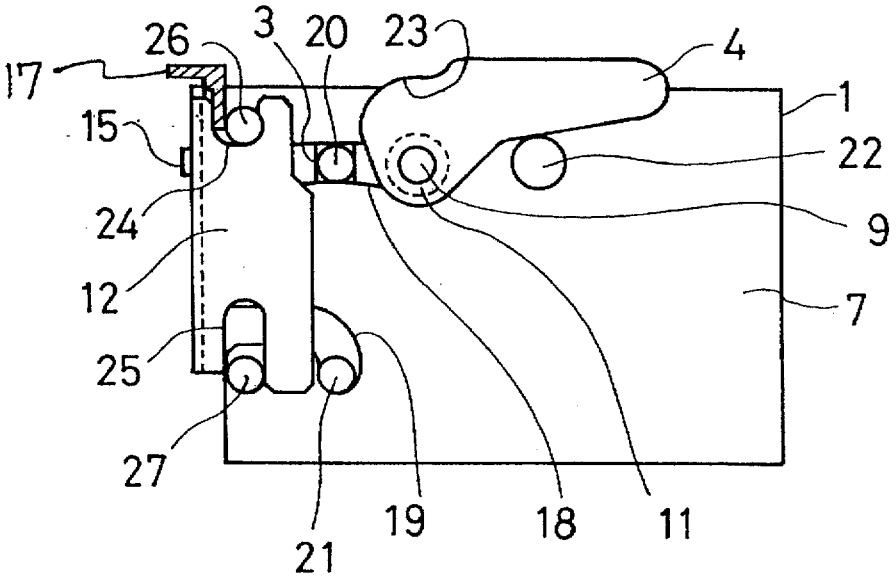

FIG. 1A is a plan view representing a line printer according to an embodiment of the present invention. FIG. 1B is a side view showing the line printer, as viewed from an arrow "T" direction.

As represented in FIG. 1A, the line printer according to one embodiment of the present invention is equipped with a frame 1, a platen 2, a print head 3, and a head-up lever 4. Additionally, a motor 5 and a wheel gear 6 are provided with this line printer.

The frame 1 has a pair of side walls 7 and 8 which are separately positioned opposite to each other along the cross direction. The platen 2 has a rotation shaft 9 rotatably supported by both of the side walls 7 and 8. The print head 3 is interposed between both of the side walls 7 and 8, and is provided in pressure contact with the platen 2. The head-up lever 4 is mounted on one of side walls 7 and 8 to give influences to the print head 3, so that the pressure contact with the platen 2 is released.

Furthermore, the above-described platen 2 is connected via the wheel gear 6 assembled in the other side wall 8 to the motor 5. The platen 2 is rotated by driving the motor 5, so that the recording paper (not shown) fed along a guide surface 10 of the frame 1 is supplied to the side of the print head 3.

The print head 3 performs the printing operation under such a condition that this print head 3 is in pressure contact to the platen 2, so that the input data is printed out on the surface of the fed recording paper.

Under such a condition that the head-up lever 4 is manipulated to release the pressure contact of the print head 3, a space is produced between the platen 2 and the print head 3 to replace recording paper.

As one featured item of the present invention, the head-up lever 4 is rotatably engaged with the rotation shaft 9 of the platen 2. That is, the rotation shaft 9 of the platen 2 is utilized as a fulcrum of the head-up lever 4, whereby the total number of printer components can be reduced. Furthermore, this head-up lever 4 has a cylindrical projection 11 fitted to the side wall 7 of the frame 1, and thus this projection 11 functions as a bearing with respect to the rotation shaft 9 of the platen 2. As a consequence, the total number of printer components may be further reduced.

As another featured item of the present invention, the print head 3 is detachably mounted on both of the side walls 7 and 8 of the frame 1, and further is in pressure contact with the platen 2 in parallel thereto. Furthermore, a rear plate 12 is detachably engaged with both of the side walls 7 and 8, so that the print head 3 is held and fixed. The print head 3 is integrally equipped with an elastic member 13 abutting on the rear plate 12, and the print head 3 is in pressure contact with the platen 2 in parallel therewith upon receipt of the energizing or surging force of the elastic member 13. In this embodiment, the elastic member 13 is made of a compression coil spring 14, and is mounted on a shaft or pin 15 formed in a center of the print head 3 along the cross direction thereof. A head portion of the pin 15 projects through a notch 16 formed in the rear plate 12. It should be noted that there is provided a lock lever 17 between the above-described notch 16 and compression coil spring 14.

In response to the energizing force exerted from the elastic member 13 having the above-described structure to the central point of the print head 3 along the cross direction, the print head 3 is in pressure contact with the platen 2 in parallel thereto. The print head 3 may follow inclinations thereof with respect to the platen 2, so that a so-called "floating effect" may occur to avoid eccentric abutting. Since the lock lever 17 is pivoted with respect to the rear plate 12 while the pin 15 for supporting the elastic member 13 is employed as a rotation center, and thus is positioned between the frame 1 and the rear plate 12, it is possible to prevent the rear plate 12 from being released. Also, when the lock lever 17 is pivoted to the locking release position, this rear plate 12 can be dismounted, removed. As a result, the print head can be dismounted, or removed from the frame.

Next, a description will now be made of another feature of the present invention with reference to FIG. 1B.

In the side wall 7 of the frame, there are formed a first guide groove 18 located near the platen 2 and a second guide groove 19 located far from the platen 2. On the other hand, both of a first pin 20 detachably engaged with the first guide groove 18 and a second pin 21 detachably engaged with the second guide groove 19 are integrally formed on the edge portion of the print head 3. It should be noted that although not shown in this drawing, a first guide groove and a second guide groove are similarly formed on the other side wall 8 and a first pin and a second pin are integrally formed on another edge portion of the print head, and then these first and second pins are detachably engaged with the corresponding first guide groove and second guide groove.

The print head 3 is positioned with regard to the platen 2 by engaging the first guide groove 18 with the first pin 20. On the other hand, the second pin 21 of the print head 3 is floatingly-journalled by way of the second guide groove 19, and thus functions as a free fulcrum when the pressure contact of the print head 3 against the platen 2 is released. In other words, there is provided a play between them.

As previously explained, the head-up lever 4 is pivotally journalled with respect to the rotation shaft 9 of the platen. Under the condition shown in FIG. 1B, the head-up lever 4 abuts against a stopper 22, and therefore is located at the home position. At this time, a cam surface 23 of the head-up lever 4 is separated from the first pin 20, and then the print head 3 is under pressure contact condition. As previously explained, the cylindrical projection 11 integrally formed on the head-up lever 4 is engaged with the side wall 7, and thus functions as a bearing with regard to the rotation shaft 9 of the platen.

A pair of U-shaped notches 24 and 25 are formed on both upper and lower edge portions of the rear plate 12. On the other hand, a pair of projections 28 and 27 are formed on the side wall 7 of the frame. The rear plate 12 is detachably engaged with a pair of projections 28 and 27 formed on the sidewall 7 by way of the pair of upper/lower U-shaped notches 24 and 25. When the rear plate 12 to be separated from the frame, first of all, the lock lever 17 is pivoted up to such a position that the lock lever 17 is dismounted from a space defined between the rear plate 12 and the frame 1, namely the locking release position. Furthermore, the rear plate 12 is once moved downwardly along the lower U-shaped notch 25 to cause the upper U-shaped notch 24 to the dismounted from the projection 28. Subsequently, the notch 25 is dismounted from the other projection 27. When the rear plate 12 is to be mounted, the above-described dismounting procedure may be performed in the reverse direction.

Figure 2:
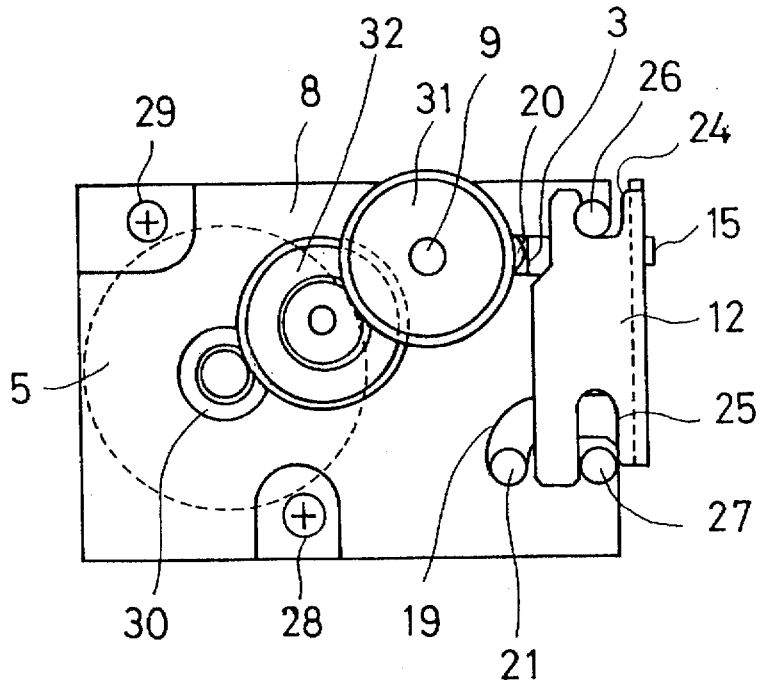
FIG. 2 is another side view for showing the line printer according to this embodiment of the present invention.

FIG. 2 is a side view of the line printer shown in FIG. 1, as viewed along a direction of an arrow II indicated in FIG. 1A.

A structure provided on the side of the side wall 8, shown in this drawing, is in principle identical to that provided on the side of the side wall 7 indicated in FIG. 1B, and the same reference numerals are employed as those for denoting the corresponding components for the sake of easy understanding. Instead of the head-up lever 4, a wheel gear is assembled into the structure provided on the side of the side wall 8.

As illustrated in FIG. 2, the motor 5 is fixed by screws 28 and 29 inside the side wall 8. A pinion 30 is mounted on the rotation shaft of the motor 5. On the other hand, a drive gear 31 is fixed on the rotation shaft 9 of the platen. The, the pinion 30 is coupled via an intermediate gear 32 with the drive gear 31, and the rotation torque of the motor 5 is transferred to the rotation shaft 9 of the platen at a preselected reduction ratio.

Figure 3:
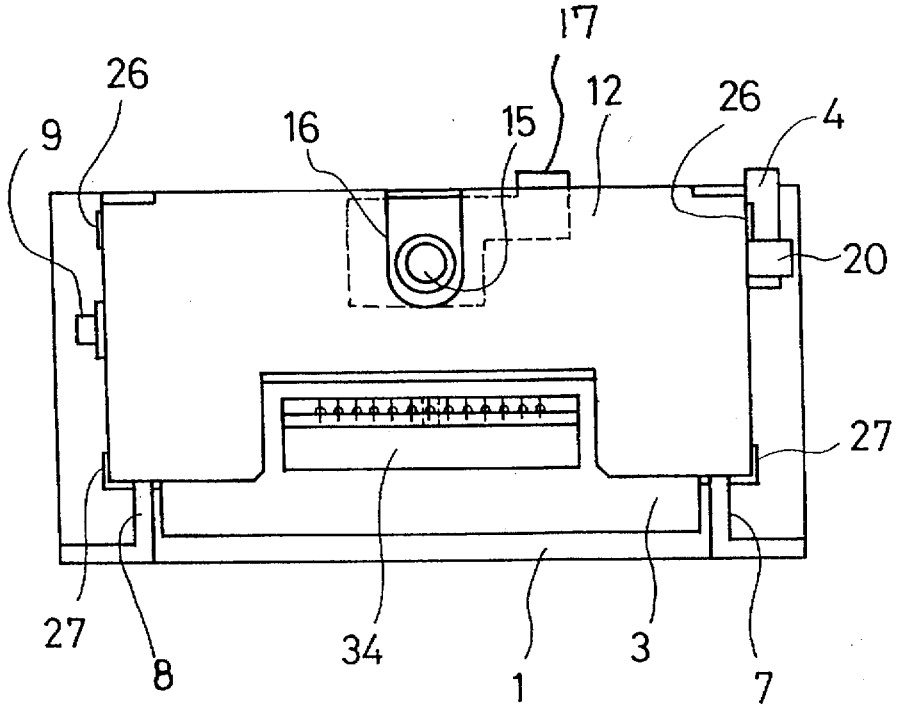
FIG. 3 is a rear view for indicating the line printer of FIGS. 1A and 1B.

FIG. 3 is a rear view of the line printer shown in FIG. 1A, as viewed along a direction of an arrow III indicated in FIG. 1A.

As previously described, the notch 16 is formed at a center of the rear plate 12, and may cause a top portion of the pin 15 formed on the print head 3 to be escaped away. A compression coil spring constituting an elastic member is mounted on this pin 15. In this drawing, the compression coil spring is located at the rear portion of the lock lever 17. The lock lever 17 is journalled to the pin 15 in conjunction with the compression coil spring in such a manner that the lock lever 17 can be rotated around the pin 15 as a rotation center. As previously stated, the rear plate 12 is engaged with the projections 26 and 27 formed on the pair of frame side walls 7 and 8. It should be noted that a connector 34 is mounted on the lower portion of the print head 3 so as to be electrically connected to an external power line.

Referring now to FIGS. 4 to 6, operations of the line printer will be described in detail.

First, FIG. 4 represents operations of the head-up lever 4.

Figure 4A:
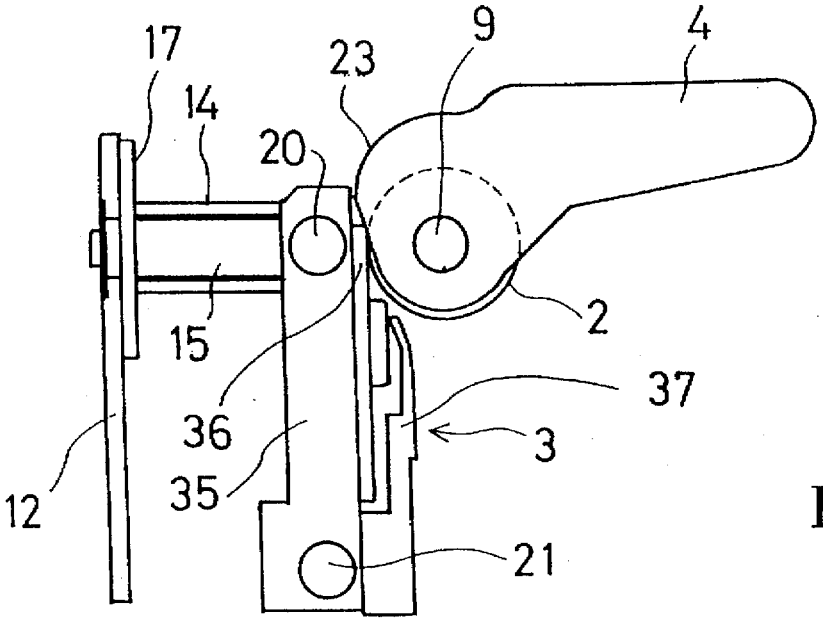
FIGS. 4A and 4B are illustrations for explaining head up operations of the line printer according to the present invention.

FIG. 4A indicates the home position of the head-up lever 4.

Under this condition, the cam surface 23 of the head-up lever 4 is separated from the first pin 20 of the print head 3. As a consequence, the print head 3 is in pressure contact in parallel with the platen 2 by the energizing force of the compression coil spring 14. It should be noted that the print head 3 is constructed of a thermal head in this embodiment. The thermal head is made of an integral structure of a heat radiation plate 35, a heating member 36, and a cover member 37. The, the first pin 20 and the second pin 21 are integrally formed with the head radiation plate 35 made of a metal.

Figure 4B:
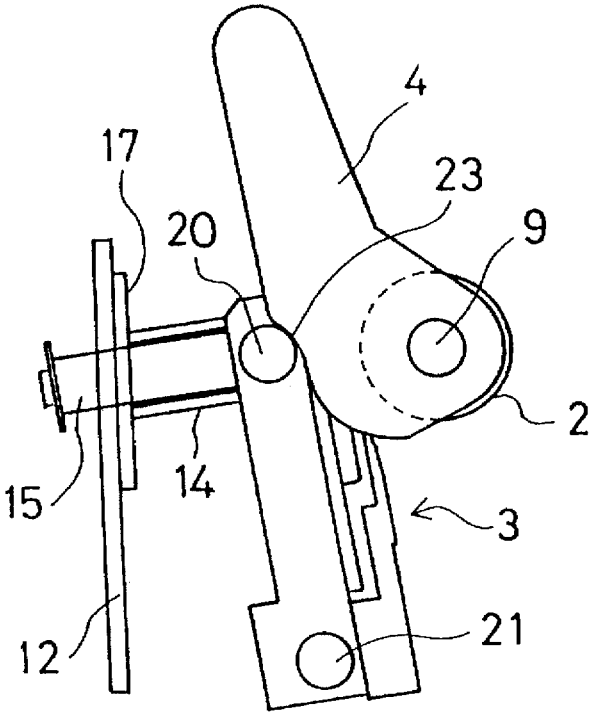

FIG. 4B illustrates the open position under which the head-up lever 4 is pivoted around the rotation shaft 9 of the platen 2 in the counter-clockwise direction.

Under this open condition, the cam surface 23 of the head-up lever 4 abuts against the first pin 20 to cause the print head 3 to be separated from the platen 2 against the energizing force of the compression coil spring 14. At this time, the print head 3 is pivoted around the second pin 21 as the fulcrum in the counter-clockwise direction. Simultaneously, the top portion of the pin 15 planted in the print head 3 is projected through the notch 16 formed in the back plate 12.

Next, FIG. 5 represents such a condition that the first pin 20 and the second pin 21 which are integrally formed in the edge portion of the print head 3 are moved.

Figure 5A:
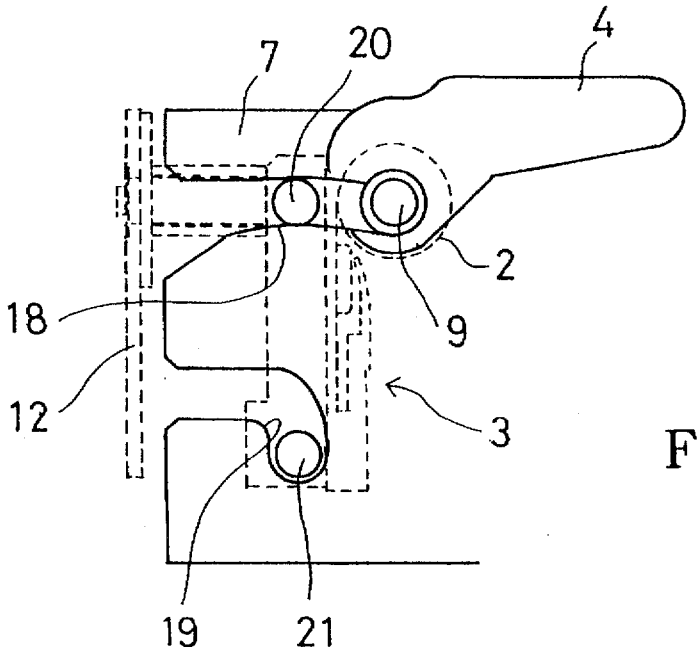
FIGS. 5A and 5B are illustrations for explaining moving condition of the print head of the line printer according to the present invention.

In FIG. 5A, the print head 3 is in pressure contact with the platen 2. At this time, the first pin 20 is precisely positioned by the corresponding first guide groove 18, and the print head 3 is correctly positioned with respect to the platen 2.

On the other hand, the second pin 21 is engaged with the second guide groove 19 under a floating condition, thereby producing a play. This play is designed to be, for instance, on the order of 0.4 mm. Distortion of the parts as well as the machining tolerance thereof may be absorbed by forming this play.

The formation of this play can also enable the print head 3 to be easily mounted/dismounted with respect to the side wall 7 of the frame 1 during replacement and assembling of the print head.

As illustrated in the drawing, the edge portions of the first guide groove 18 and the second guide groove 19 are opened, so that the first pin 20 and the second pin 21 can be readily engaged with these first and second guide grooves 18 and 19 via the edge portions thereof.

Figure 5B:
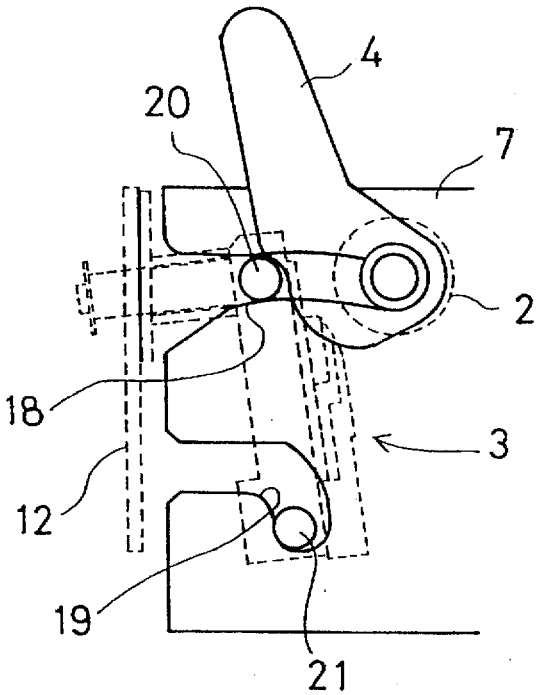

FIG. 5B indicates such a condition under which the print head 3 is separated from the platen 2.

When the head-up lever 4 is pivoted in the counter-clockwise direction so as to release the pressure contact of the print head 3 against the platen 2, the first pin 20 is moved back along the first guide groove 18. On the other hand, the second pin 21 is stopped at the bottom portion of the second guide groove 19, and then is rotated under a floating condition. As a consequence, it is possible to realize such a smooth operation for releasing the print head 3 from pressure contact with the platen 2.

In other words, at the starting stage of releasing of the pressure contact of the print head 2, the second pin 21 is moved in parallel inside the second guide groove 19 by a distance equal to the play. Subsequently, when the second pin 21 abuts the edge portion of the second guide groove 19, the second pin 21 is moved in a circular motion. As a result, the smooth operation of the head-up lever 4 can be achieved.

Finally, FIG. 6 illustrates mounting/dismounting operations of the print head 3.

Figure 6A:
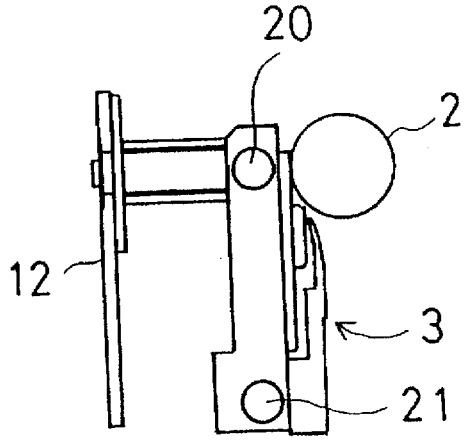
FIGS. 6A, 6B, and 6C are explanations for explaining replacement steps of the print head of the line printer according to the present invention.

FIG. 6A illustrates such a condition that the print head 3 is assembled in the line printer.

In this condition, the print head 3 is in pressure contact with the platen 2. The print head 3 is held by the rear plate 12 under a fixed condition.

Figure 6B:
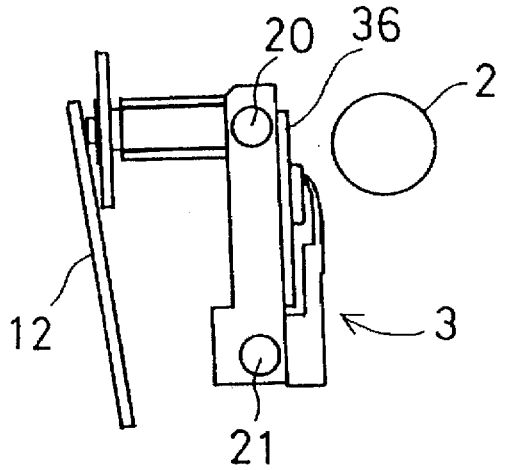

FIG. 6B represents such a condition that the upper edge side of the rear plate 12 is separated from the side wall of the frame.

At this time, since the application of the energizing force produced by the elastic member 13 is released, the print head 3 is easily pivoted around the second pin 21 as a rotation center along the counter-clockwise direction, so that the print head 3 is separated from the platen 2. Then, since the surface of the heating member 36 is exposed, such a process operation as cleaning can be very easily performed.

Figure 6C:
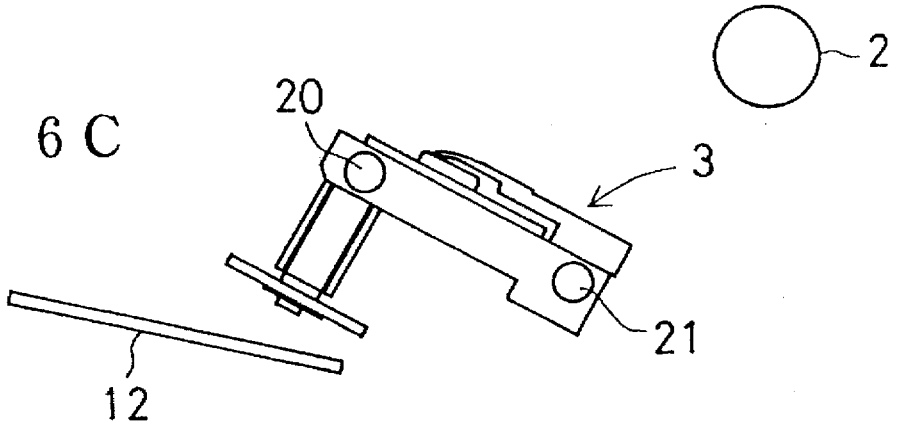

FIG. 6C represents such a condition that the rear plate 12 is completely dismounted from the frame.

At this time, the first pin 20 and the second pin 21 of the print head can be removed from the corresponding guide grooves, with the result that the print head 3 can be completely removed from the frame. As a consequence, the print head can be very easily replaced.

As previously described, according to the present invention, both the head-up lever and the bearing of the platen are designed in an integral form. Positioning of the print head with regard to the platen is achieved by the establishment of engagement between the first pin integrally formed on the print head with the first guide groove formed on the side wall of the frame. The print head is energized or biased against the platen by way of a single compression coil around the near center position of the platen along the upper direction. This compression coil spring is mounted on the side of the print head. The play is formed at the fulcrum of the head-up lever. The print head is held by a single sheet rear plate under a fixed condition. When the rear plate is removed, the print head may be dismounted. With the foregoing structure, there is an advantage that the line printer according to the present invention can be simply assembled and also the print head can be easily replaced. Furthermore, the lock lever 17 is pivoted to be dismounted from the space defined between the rear plate 12 and the frame 1. As a result, the rear 12 is removed from the frame and thus the print head can be removed. There is another advantage that since the components or parts are commonly utilized and further are made in an integral form, the manufacturing cost of the line printer can be markedly reduced. There is a further merit that the line printer can be made compact in size. In addition, there are additionally provided such advantages that since the print head is in pressure contact with the platen under uniform pressure, the printing quality can be improved, and further since a mechanism for preventing the rear plate from being dismounted is employed, such erroneous operations can be avoided, by for instance, the print head being accidentally dismounted.

What is claimed is:

1. A line printer comprising: a frame having a pair of side walls which are separately positioned opposite to each other along a cross direction thereof; a platen pivotally journalled between the side walls; a print head disposed between the side walls and positioned in pressure contact with the platen; a first guide groove provided in each of the side walls of the frame and located near the platen; a second guide groove provided in each of the side walls of the frame and located apart from the platen; a first pin detachably engaged with the first guide groove; and a second pin detachably engaged with the second guide groove, the first and second pins being formed integrally with edge portions of the print head.

2. A line printer as claimed in claim 1; wherein the print head is positioned with respect to the platen by establishing the engagement between the first pin and the first guide groove and between the second pin and the second guide groove.

3. A line printer as claimed in claim 1; wherein the second pin of the print head is journalled by the second guide groove under a floating condition and functions as a free fulcrum when the pressure contact of the print head against the platen is released.

4. A line printer as claimed in claim 1; wherein the print head is provided in pressure contact with the platen in parallel relation therewith by receiving an energizing force exerted on a center point of the print head along the cross direction thereof.

5. A line printer comprising: a frame having a pair of spaced-apart side walls; a platen rotatably journalled between the side walls of the frame; a print head detachably mounted on the side walls of the frame and positioned in pressure contact with the platen in parallel relation therewith; a rear plate detachably engaged with the side walls of the frame for supporting the print head; an elastic member integral with the print head and abutting against the rear plate for urging the print head into pressure contact with the platen in parallel relation therewith; and a lock lever disposed between the rear plate and the frame.

6. A line printer as claimed in claim 5; wherein the elastic member is supported by a shaft integral with the print head, and the lock lever is mounted for pivotal movement about the shaft, whereby the rear plate is prevented from being disconnected from the side walls of the frame.

* * * * *